United States Patent [19]

Waggoner

[11] Patent Number: 5,022,314

[45] Date of Patent: Jun. 11, 1991

[54] ROOF VENTILATING APPARATUS

[75] Inventor: Richard L. Waggoner, Riverside, Calif.

[73] Assignee: Alumax Inc., Norcross, Ga.

[21] Appl. No.: 356,337

[22] Filed: May 24, 1989

[51] Int. Cl.[5] ..... F24F 7/00; F24F 7/02

[52] U.S. Cl. ..... 98/32; 98/42.21; 98/DIG. 6

[58] Field of Search ..... 98/29, 32, 37, 42.21, 98/121.1, DIG. 6; 52/57, 95, 199

[56] References Cited

U.S. PATENT DOCUMENTS

| | | | |
|---|---|---|---|
| 678,189 | 7/1901 | Marshall | 52/95 X |
| 1,230,305 | 6/1917 | Klay | 98/42.21 |
| 1,717,728 | 6/1929 | Moore | 98/42.21 |
| 2,513,056 | 6/1950 | Scallon | 98/32 |
| 2,777,381 | 1/1957 | Hoyes et al. | 98/37 |
| 2,803,185 | 8/1957 | Coleman | 98/DIG. 6 X |
| 2,868,104 | 1/1959 | Honholt et al. | 98/42.21 |
| 2,936,723 | 5/1960 | Waldron | 52/302 |
| 2,954,727 | 10/1960 | Katt et al. | 98/32 |
| 3,196,773 | 7/1965 | Lorenz et al. | 98/32 |
| 3,236,170 | 2/1966 | Meyer et al. | 98/42.21 |
| 3,241,474 | 3/1966 | Rousey et al. | 98/42.21 |
| 3,949,657 | 4/1976 | Sells | 98/42.21 |
| 4,201,121 | 5/1980 | Brandenburg, Jr. | 98/42.21 |
| 4,254,598 | 3/1981 | Rugroden | 52/199 |
| 4,278,071 | 7/1981 | Brill-Edwards | 52/95 |
| 4,280,399 | 7/1981 | Cunning | 98/42.21 |
| 4,446,661 | 5/1984 | Jonsson et al. | 52/95 |
| 4,598,505 | 7/1986 | McGown | 98/42.21 X |
| 4,611,443 | 9/1986 | Jorgensen et al. | 52/95 |
| 4,642,958 | 2/1987 | Pewitt | 98/32 X |
| 4,762,053 | 8/1988 | Wolfert | 98/37 |
| 4,776,262 | 10/1988 | Curran | 98/37 |
| 4,817,506 | 4/1984 | Cashman | 98/42.21 |
| 4,903,445 | 2/1990 | Mankowski | 98/42.21 X |

FOREIGN PATENT DOCUMENTS

| | | | |
|---|---|---|---|
| 1073258 | 3/1980 | Canada | 98/32 |
| 2193515 | 2/1988 | United Kingdom | 98/32 |

OTHER PUBLICATIONS

"Principles of Attic Ventilation", Fourth Edition, Air Vent Inc., Peoria Hts., Ill, 1985.

*Primary Examiner*—Harold Joyce

*Attorney, Agent, or Firm*—Raymond B. Cranfill

[57] ABSTRACT

Ridge cap ventilators and roof constructions incorporating such ventilators are disclosed. The ridge cap ventilator is low in profile and comprises either two corrugated vertilating members and a cover member, or alternatively comprises of a single piece member which has a plurality of raised ribs. Both ridge caps have a plurality of channels through which air is educed from the roof cavity to the building exterior.

23 Claims, 5 Drawing Sheets

ROOF VENTILATING APPARATUS

FIELD OF THE INVENTION

The present invention relates generally to ventilation of building spaces under roofs and like structures and more particularly to roof ridge ventilators and roof constructions which include such ventilators.

BACKGROUND OF THE INVENTION

The need for venting hot and humid air from building spaces beneath roofs is well known. Without adequate and controlled ventilation of attics and like spaces, damage results to the roof structure, as well as to articles stored within the attic or like space. For instance, accumulated attic heat during cold winters may melt snow on the roof which can then refreeze in and damage gutters and drainage systems. Furthermore, lack of proper ventilation makes cooling and heating the remainder of the building more difficult, and permits the accumulation of condensed moisture which reduces effectiveness of insulation and may result in stained interior panels as well as promote mildew.

Although there are many known ridge cap ventilators and systems for ventilating roofs, each is frequently deficient in several respects. In many cases, the ventilator or ventilating system is bulky, cumbersome and very expensive to manufacture. See, for example, U.S. Pat. Nos. 3,241,474 and 4,201,121. Such ventilators also problematic because they are not easily adapted to a wide variety of roof angles or roof surfaces. Yet other apparatus suffers from an inability to achieve complete ventilation, i.e., U.S. Pat. No. 2,513,056. On the other hand, some know devices fail to properly regulate air flow through a building space because they educt air too quickly. See, for example, U.S. Pat. No. 3,949,657. Many ventilating apparatus have high profiles which necessitate additional building materials and expense and destroy the aesthetic character of the roof. See for example, U.S. Pat. Nos. 3,241,474; 4,611,443; and 4,776,262. A problem common to all these devices is an inadequate ability to exclude insects and other pests.

Thus, there is a need for roof ventilating apparatus that is simple in construction, durable and easy to adapt to the existing conformities of a roof, that is low in profile relative to the roof structure, that is capable of providing full circulation without leaving dead spots where hot, humid air can accumulate and that is capable of preventing insects and other pests from entering the building space.

SUMMARY OF THE INVENTION

An object of the present invention is to provide a ridge cap ventilator that simple, lightweight and inexpensive to manufacture and install and yet is sufficiently strong and durable so as not to require further reinforcement or modification once installed.

Another object of the present invention is to provide ventilators that are low in profile relative to roof configuration.

Another object of the present invention is to provide ventilators that are easily adaptable to a variety of roof ridge angles.

A further object of the present invention is to provide ventilators that are easily adaptable to nonplanar roof surfaces.

Yet another object of the present invention is to provide a system of ventilation in a roof construction that promotes full circulation of air within the space to be ventilated.

Another object of the present invention is to provide ventilators capable of excluding entry of precipitation and insects or other pests into the space to be ventilated.

The ventilation apparatus and systems of the present invention achieve these objectives by providing novel ridge cap ventilators, and by providing novel ventilating systems which employ the ridge cap ventilators of the present invention with other types of ventilators.

The ridge cap ventilator may be a single unit or an assembly of several pieces but is configured to be received over a gap in a roof ridge, thereby closing off the space beneath the roof ridge gap from direct access to the outside. The ridge cap ventilator is further is provided with a single row of substantially parallel channels or conduits such that the channels are in communication both with the interior building space via the roof ridge gap and with air outside the building. The ridge cap ventilator is further provided with a flange projecting above and spaced apart from the downwardly facing ends of the channels so as to prevent air from the outside from blowing directly into the channels. This configuration is advantageous because it provides a ridge cap that is low in profile, that is simple and much easier to make and install, and because it provides a ridge cap ventilator that requires no further reinforcement. Another advantage of this configuration is that the disposition of the channels and the flange allow good control over the rate at which a building space will be vented.

The ridge cap ventilator is also provided with a fiberglass filter to prevent entry of insects or other like pests from entering the building space. Furthermore, these ventilators can also be provided with plastic adapter members, either incorporated into the ventilators or as separate pieces, that permit these ventilators to be adapted to roofing that has a nonplanar surface. This is advantageous because it allows for an airtight and watertight seal to be formed between the roof and ventilator and because it obviates the need to produce specific ventilators which are specially configured for a particular roof surface.

Finally the present invention also includes roof constructions that incorporate the ridge cap ventilator with either or both the gable and fascia ventilator in order to ensure complete air circulation within the building space, thereby maximizing the ventilating capacities of the apparatus.

DESCRIPTION OF THE PREFERRED EMBODIMENTS

Figure 1:
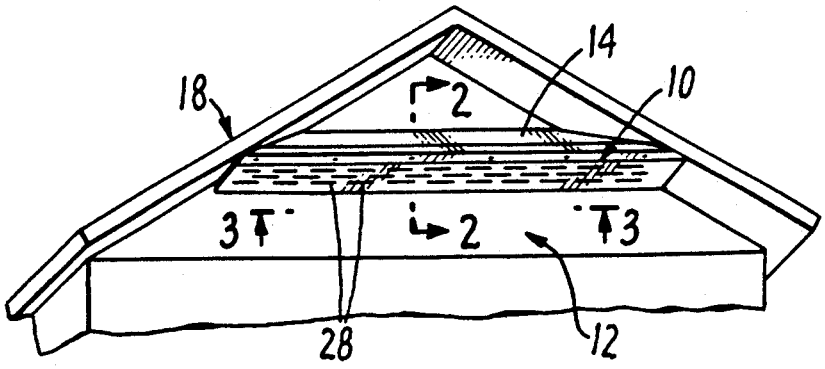
FIG. 1 is a view in perspective of a first embodiment of the gable ventilator of the invention.
Figure 2:
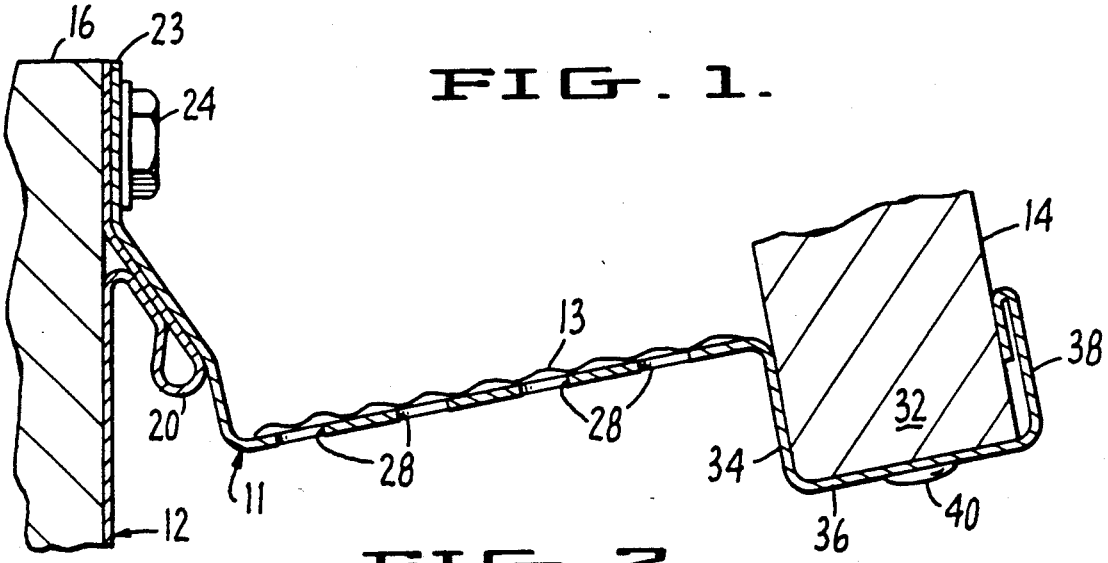
FIG. 2 is a view in cross-section of the first embodiment of the gable ventilator taken on the plane designated by line 2—2 in FIG. 1.
Figure 3:
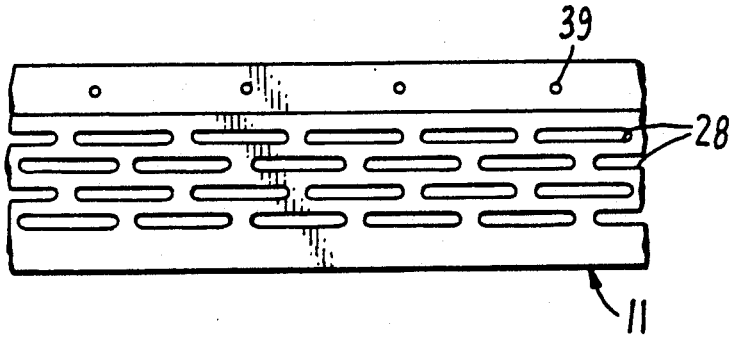
FIG. 3 is a bottom plan view of the ventilating member of the first embodiment of the gable ventilator taken on the plane designated by the line 3—3 in FIG. 1.
Figure 4:
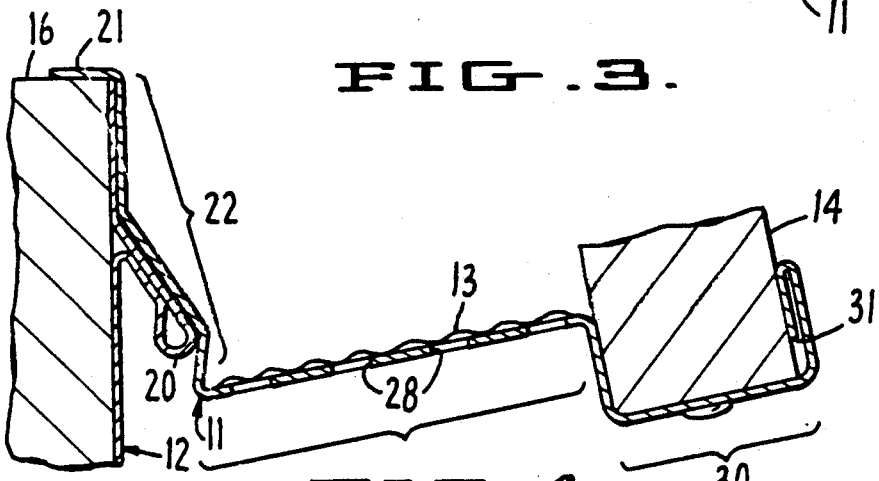
FIG. 4 is a view in cross-section of a second embodiment of the gable ventilator of the invention.
Figure 5:
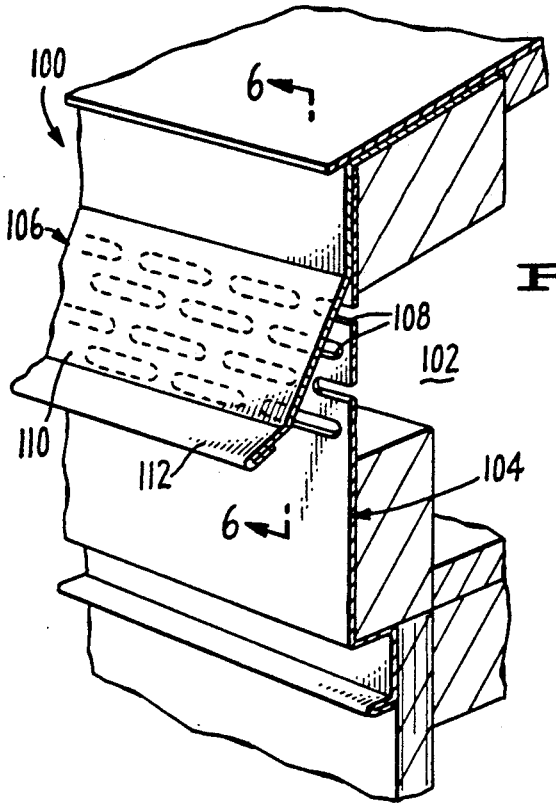
FIG. 5 is a cross-sectional view in perspective of a first embodiment of the fascia ventilator of the invention.
Figure 6:
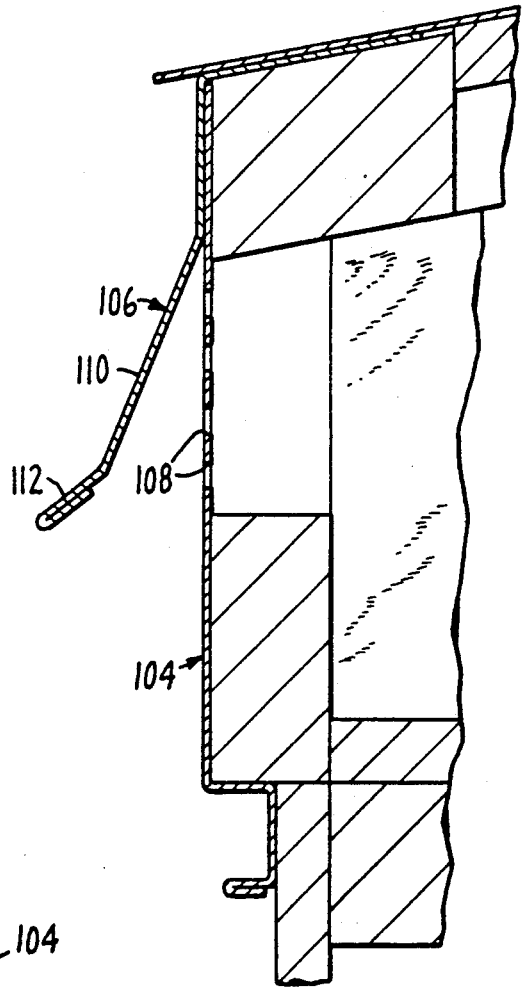
FIG. 6 is a view in cross-section of the first embodiment of the fascia ventilator taken along the line 6—6 in FIG. 5.
Figure 7:
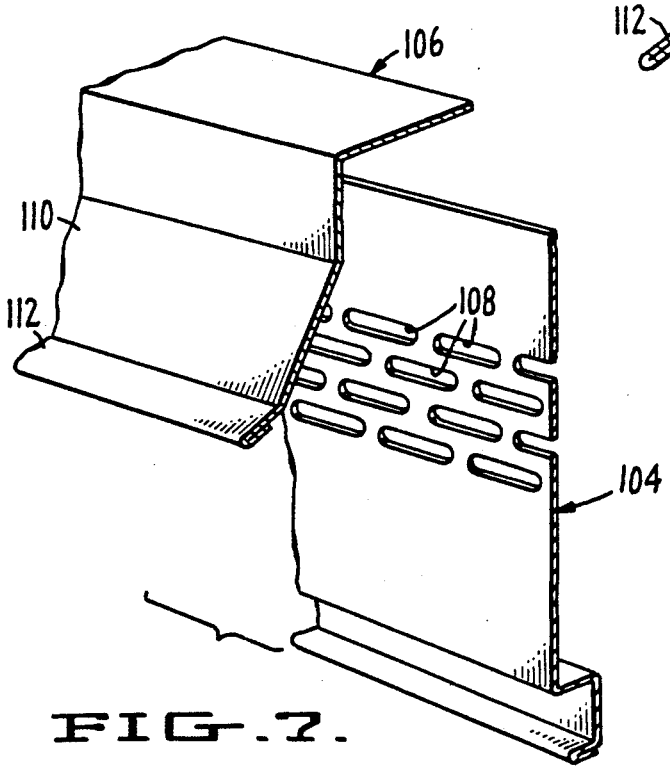
FIG. 7 is an exploded view in perspective of the cover member and ventilating member of the first embodiment of the fascia ventilator.

Referring now to FIGS. 1-4, the gable ventilator 10 of the present invention will be described. The gable ventilator 10 is comprised of a vent member 11, a bracket 12 and a filter 13, the assembly of which receives and displaces an eave panel 14 so that air may enter the building through the gable.

The bracket 12 is used to support and position the vent member 11 and eave panel 14 at any convenient position along a wall 16 of a gable 18. The bracket 12 is provided with a lip 20 which runs transversely the length of the bracket. In the preferred embodiment, the lip 20 is formed by folding the bracket 12 back on itself which gives the lip 20 a hairpin configuration in cross-section. The lip 20 assists in supporting the gable vent 11. The bracket 12 is configured to receive screws 24 which secure it in place. Alternatively, the bracket may be provided with an anchor 21 which is received over an end of the gable wall 16, thereby positioning the gable ventilator 10 and holding it in place once the eave panel 14 is secured to the gable vent 11 and the gable 18. The bracket 12 may be fabricated from any suitably durable material such as metal or polymer plastic.

The gable vent 11 comprises an elongate sheet that is divided into three main portions. The first portion 22 runs the length of the gable vent 11 along the first free edge 23, and is configured to be received over the bracket 12. In the embodiment shown in FIG. 2, the first portion 22 of the gable vent 11 is provided with holes (not shown) for receiving screws 24. The second portion 26 of the gable vent 11 is contiguous with and extends parallel to the first portion 22. This second portion 26 is substantially planar and is provided with a plurality of apertures 28 allowing air to pass through the gable 18 into the building structure. The third portion 30 of the gable vent 11 is contiguous with and runs parallel to the second portion and includes the second free edge 31, and is configured to receive and secure the eave panel 14. In the preferred embodiment, the third portion provides a groove 32 having a first wall 34, a second wall 36, and a third wall 38. The second free edge 31 is reflexed back on itself into the groove 32. The eave panel 14 is emplaced in groove 32 where it is held in place by frictional force created by the reflexed second free edge 31 pushing the eave panel 14 into contact with the first wall 34 of the groove 32. In addition, the second wall 36 of groove 32 may be provided with holes 39 to receive screws 40 which can be used to secure the eave panel 14 within the groove 32 of the gable vent 11. The gable vent 11 may be fabricated from any durable material, although polymer plastic is preferable on account of its light weight and low cost.

The filter 13 is affixed to the internal surface of the gable vent 11 over the apertures 28 so that no air may pass through the apertures 28 into the building without first passing through the filter 13. The filter itself may be composed of a variety of materials although spun fiberglass, such as angel's hair, is preferred. The filter should be of adequate density and thickness so as to prevent the ingress of insect and like pests, such as wasps, termites, etc. into the interior of the building.

The gable ventilator 10 may be installed along one eave panel 14 of a gable as shown in FIG. 1, or may be installed along several panels, depending upon the degree and rate of ventilation desired. Ventilation through the gable may be achieved in one of two ways. Two or more gable ventilators may be used on opposite sides of a roof construction to permit air to flow through the roof construction. In addition, the gable ventilator may be used in combination with a ridge cap ventilator, wherein the gable ventilator provides an opening for air to enter the interior building space as it is lost through the roof ridge by eduction.

FIGS. 8-15 illustrate various embodiments of the ridge cap ventilator 50 of the present invention. The ridge cap ventilator 50 is configured for receipt over a roof ridge or crest having a gap 52. The roof ridge may divide the roof into two sloping roof sides 54, or in some cases, the gap 52 may run along a roof ridge that divides a roof side 54 and a vertical wall (not shown). The ridge cap ventilator 50 of the present invention is adaptable to either of these roof configurations.

In one embodiment of the present invention, as shown in FIGS. 8-11, the ridge cap ventilator 50 comprises support members 56, ventilating members 58, a cover member 60 and a filter 62. The support members 56 are elongate sheets configured to the length of the roof ridge gap. The support members 56 are affixed by known methods to the roof sides 54 proximate to the roof ridge gap 52. The members 56 may be in direct contact with the roof side 54 or more preferably, they are attached to roofing material 64 which is already in place over the roof sides 54. Each support member 56 is provided with a flange 66 that runs parallel to but which is displaced away from the roof ridge gap 52. The support members 56 may be made of polymer plastic, metal or other material which has sufficient strength and is not easily weathered.

The filter 62 is received over the roof ridge gap 52 and is affixed to the support members 56 such that no air exchange through the roof ridge gap 52 can take place without passing through the filter 62. The filter 62 is used to exclude insects and other vermin and has the same characteristics as the filter 13 of the gable ventilator 11.

Figure 9:
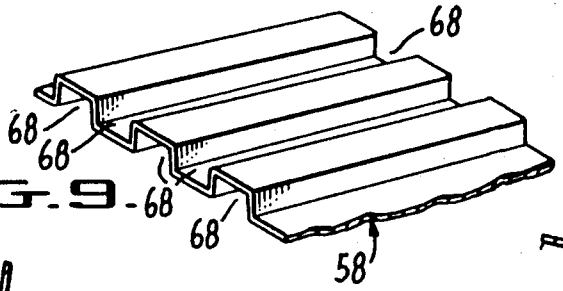
FIG. 9 is a view in perspective of a portion of the ventilating member of the ridge cap ventilator shown in FIG. 8.
Figure 10:
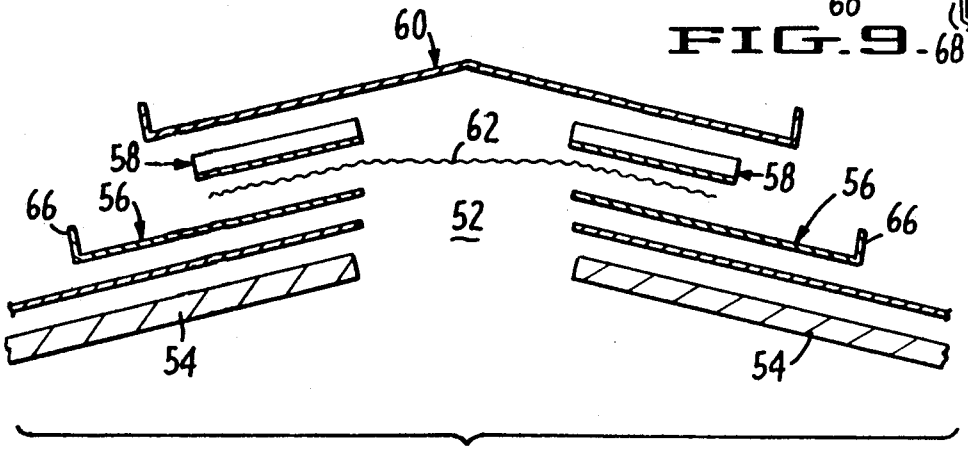
FIG. 10 is an exploded view in cross-section of the first embodiment of the ridge cap ventilator.

The ventilating members 58 comprise sheets as shown in FIG. 9. These sheets are emplaced over the support members 56, with the filter 62 sandwiched between. The ventilating members 58 should be configured and emplaced such that they are substantially adjacent to the roof ridge gap 52 and are set back from the flange 66 of the support member 56. Although they can be fabricated from any rigid material, the ventilating members are preferably made of polymer plastic.

The cover member 60 is configured for receipt by the ventilating members 58, so that the roof ridge gap 52 is bridged. It should be noted that the mating of the ventilating members 58 with the cover member 60 above and with the support members 56 below creates a single row of channels 68 in the ventilating members 58. These channels have upwardly facing apertures 70 in communication with air present in the roof ridge gap 52 and downwardly facing apertures in communication with air outside the building. The closing of the roof ridge gap 52 with the cover member 60 constrains air to pass only through the channels 68.

While not wishing to be bound by any theory of operation, it appears that ventilation is achieved when rising warm air creates a slightly greater pressure at the roof ridge, eventually forcing the warm air up through the roof ridge gap 52 and then down through the channels 68 to the outside. The flange 66 seems to be crucial in this context in that it prevents air from blowing directly into the downwardly facing apertures 72 of the channels 68 and thereby disrupting the flow of air out of the building space. In addition, the flange 66 prevent the ingress of precipitation.

An alternative embodiment is shown in FIGS 12–15. Ridge cap ventilator 80 comprises a ventilating member 82 and a filter 82. The ventilating member is form molded from a single piece of plastic, along a longitudinal axis to form two opposing, downwardly sloping sides 83, and is configured to be received over the roof ridge gap 52 and be joined with the roof sides 54. The ventilating member 82 is provided with a plurality of substantially parallel raised ribs 86 alternating with troughs 92 which extend downward along both sides 83. Each rib 86 is provided with a downwardly facing terminal aperture 88 that is in communication with the outside air at each of the two ends of the rib 86. The ventilating member 82 is further provided with a raised strip or flange 90 on each side 83. The flange 90 has a longitudinal axis that is perpendicular to the longitudinal axes of the ribs 86, and is spaced away from the ends of the ribs 86. The filter 84 is used to exclude insects and other vermin and has the same characteristics as the filter 13 of the gable ventilator 11.

The ridge cap ventilator 80 is installed as follows. First, the filter 84 is laid over the roof ridge gap 52 and affixed to roof sides 54 such that no air exchange through the roof ridge gap 52 can take place without passing through the filter 84. Next, the ventilating member 82 is positioned over the roof ridge gap 52 and affixed to roof sides 54 by known methods. The joinder of the ventilating member 82 with the roof sides 54 creates channels 90 in the portions of the raised ribs that project over the roof sides 54. Eduction of air from the interior building space to the outside occurs in a fashion similar to that described for ridge cap ventilator 50. However, in the present embodiment, the air conducting channels alternate with non-conducting troughs 92, whereas in the ridge cap ventilator 50, an unbroken row of air conducting channels 68 is present.

Figure 14:
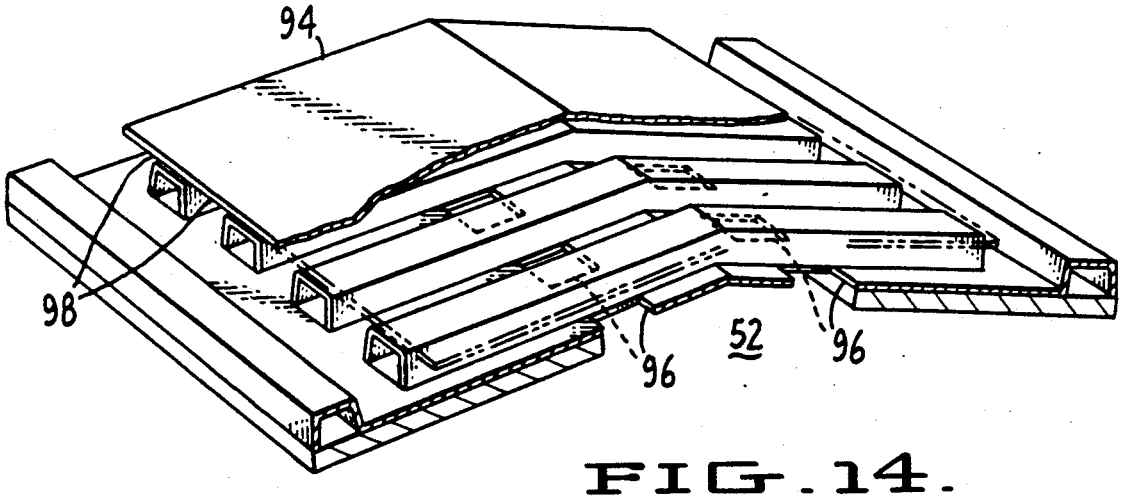
FIG. 14 is a cross-sectional view in perspective of a third embodiment of a ridge cap ventilator of the invention.
Figure 15:
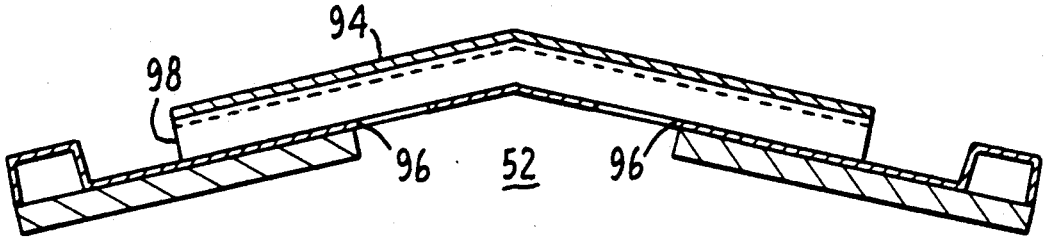
FIG. 15 is a view in cross-section of the third embodiment of the ridge cap ventilator.

A variation of the ridge cap ventilator 80 is illustrated in FIGS. 14 and 15. Here, a cover member 94 has been affixed over the ventilating member 82. In addition, a pair of medial apertures 96 have been added to each trough 92. The addition of the cover member 94 creates a second set of channels 98 by closing the troughs 92. The medial apertures 96 permit communication of the troughs with air present in the roof ridge gap 52, while the troughs 92 remain in communication with outside air. This configuration has the effect of increasing the educing capacity of the ventilating member by providing a contiguous series of air educing channels.

The fascia ventilator 100 according to one embodiment of the present invention is shown in FIGS. 5–8. In this aspect of the invention, a roof edge or cornice is provided with a cornice gap 102, which the fascia ventilator 100 is configured to cover. In this embodiment, the fascia ventilator 100 comprises a ventilating member 104 and a cover member 106. The ventilating member 104 is provided with a plurality of elongate apertures 108 to permit the passage of air into the interior of the building through the cornice gap 102. The ventilating member 104 is configured for snug receipt over the cornice so that the apertures 108 are aligned over the cornice gap 102. The ventilating member can be fabricated from any durable, resilient material, although polymer plastic and metal are preferred.

The cover member 106 comprises a sheet that is configured to be received over and attached to the upper edge of the roof cornice and is further configured to project downward for a distance sufficient to extend over the apertures 108 of the ventilating member 104. The lower portion of the cover member 106 does not close off the apertures 108, but rather is bent longitudinally to form a panel 110. The panel 110 projects out of the plane occupied by the aperture portion of the ventilating member 104 such that outside air and precipitation cannot enter the cornice gap 102 directly. The panel 110 is further configured to provide a drip lip 112 which prevents precipitation shed by the cover member 106 from running down the sides of the building. The cover member 106 may be fabricated from any durable, moldable material that is not easily weathered, although metal is preferred.

Figure 8:
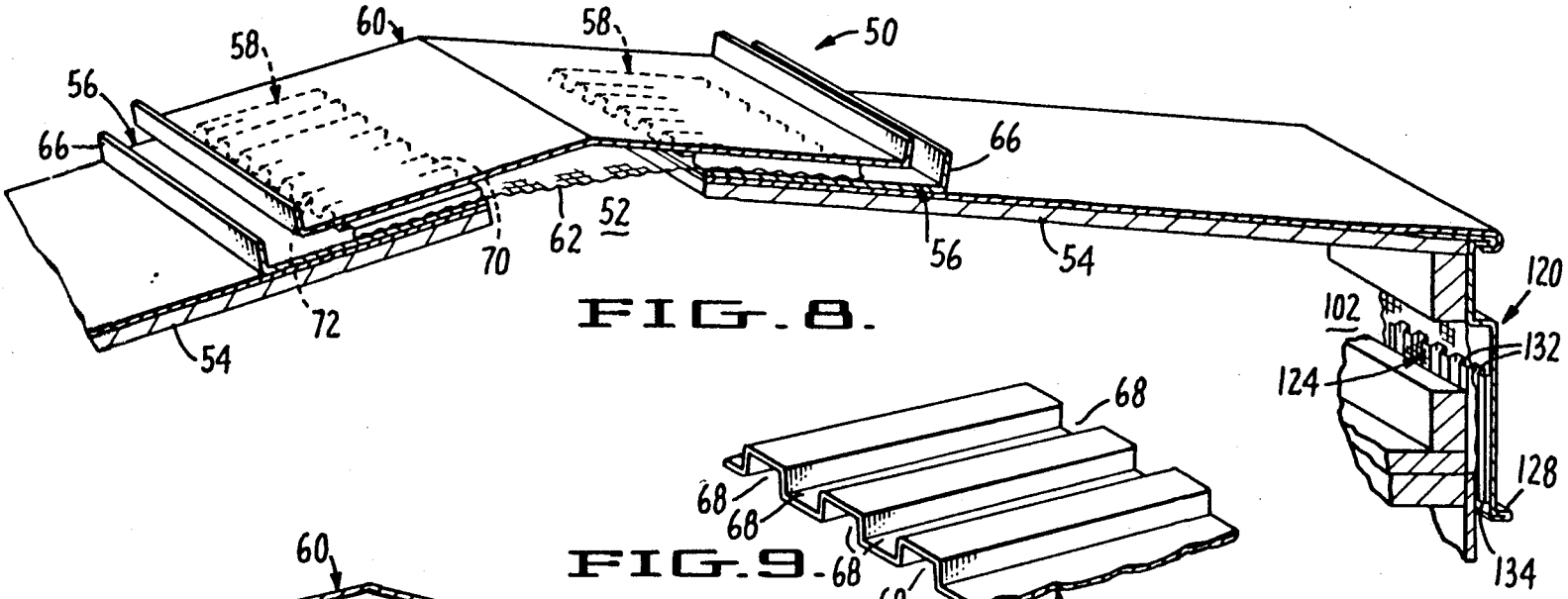
FIG. 8 is a cross-sectional view in perspective of a roof construction incorporating a first embodiment of a ridge cap ventilator and a second embodiment of a fascia ventilator of the invention.
Figure 11:
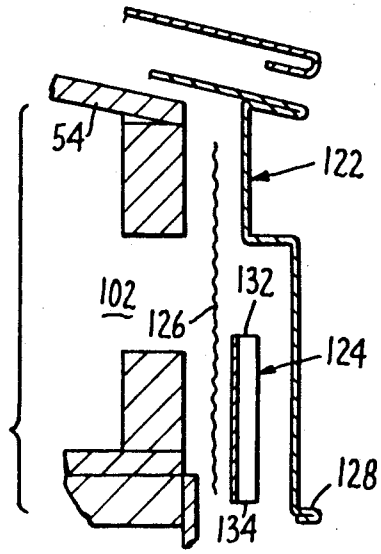
FIG. 11 is an exploded view in cross-section of the second embodiment of the fascia ventilator.
Figure 12:
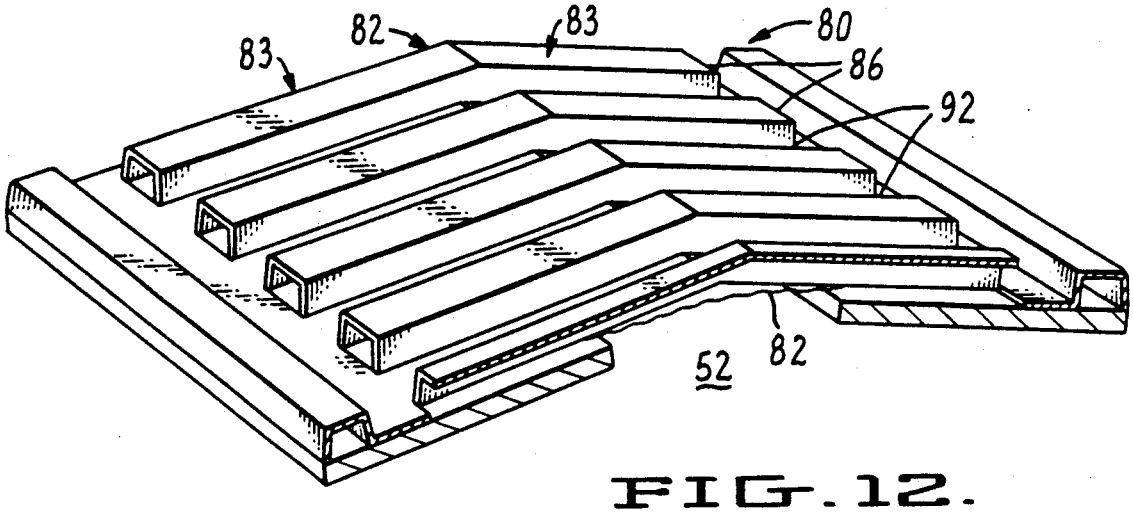
FIG. 12 is a cross-sectional view in perspective of a second embodiment of a ridge cap ventilator of the invention.
Figure 13:
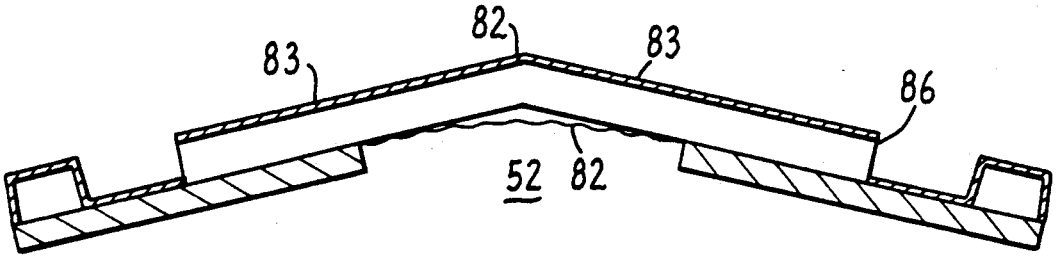
FIG. 13 is a view in cross-section of the second embodiment of the ridge cap ventilator.

A fascia ventilator 120 in accordance with an alternative embodiment of the present invention is illustrated in FIGS. 8 and 11. In this embodiment, the fascia ventilator 120 comprises a cover member 122, a ventilating member 124, and a filter 126.

The ventilating member 124 comprises a piece of corrugated material similar in all respects to the ventilating member 58 of the ridge cap ventilator 50, as shown in FIG. 9. It is configured to be received on the surface of the cornice beneath the cornice gap 52. It can be comprised of any durable, moldable material, although polymer plastic is preferable.

The cover member 122 is configured to be received at the top of the cornice and to extend over the cornice gap 52 and be joined with the ventilating member 124. It is provided with a drip lip 128 which allows precipitation to be shed from the cornice without coming in contact with and running down the building wall. The cover member 122 may be fabricated from any durable, moldable material that is not easily weathered, although metal is preferred. The filter 126 in similar in purpose and structure as the filter 13 already described and is affixed over the cornice gap to ensure that insects and like pests are excluded from the interior building space.

The sandwiching of ventilating member 124 between the surface of the cornice and the cover member 122 creates a series of channels 130 with upward facing apertures 132 in communication with air in the cornice gap 52 and downward facing apertures 134 in communication with outside air. Air entering the building interior through the cornice gap is thus constrained to pass through the channels 130.

In operation, the fascia ventilator is used in combination with a ridge cap ventilator. As air is educed through the roof ridge, it is replaced by air flowing in from the outside through the fascia ventilators.

Figure 16:
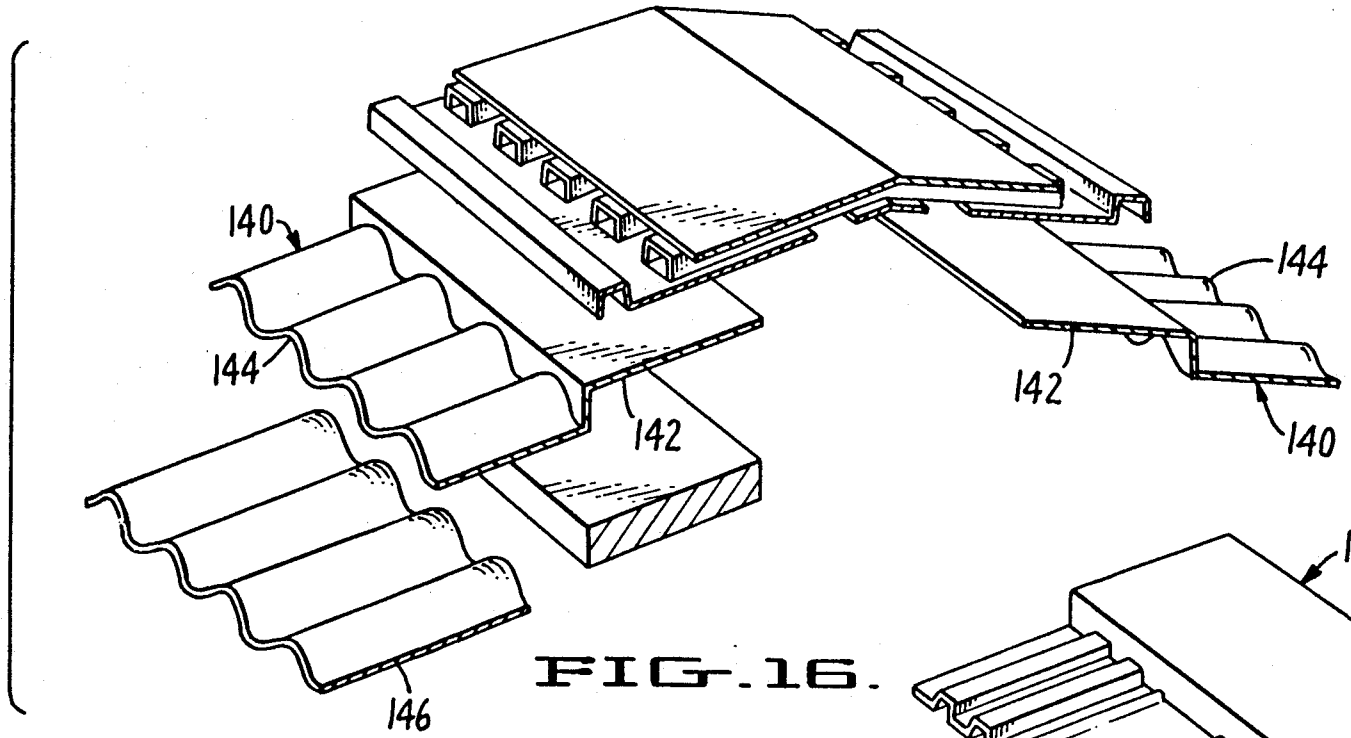
FIG. 16 is an exploded cross-sectional view in perspective of a first embodiment of a roof adaptor in combination with the third embodiment of the ridge cap ventilator.
Figure 18:
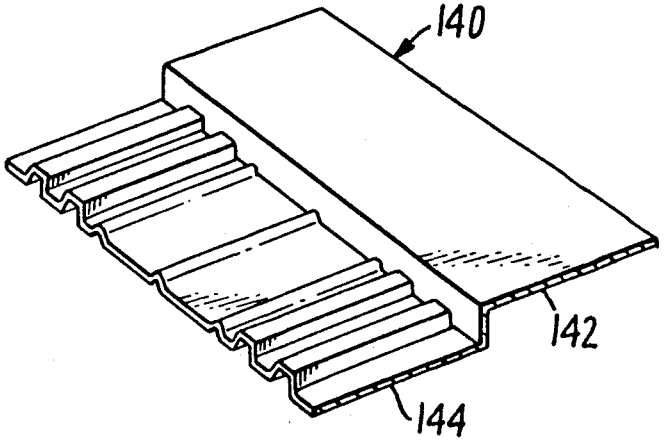
FIG. 18 is a cross-sectional view in perspective of a second embodiment of an adaptor of this invention.
Figure 17:
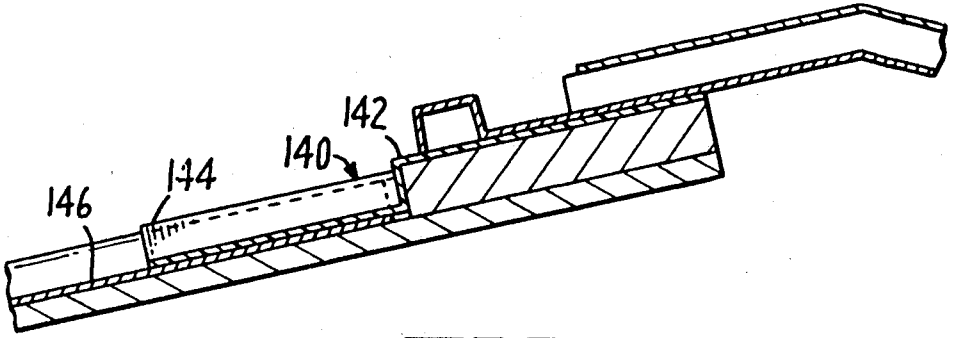
FIG. 17 is a partial view in cross-section of the first embodiment of a roof adaptor in combination with the third embodiment of the ridge cap ventilator.

In many situations, a roof surface will not be substantially planar, but rather is covered with weatherproofing materials having a three dimensional surface. In such situations, in order to have a weather tight seal between the ventilators and the roof surface, it is necessary to provide means for adapting the ventilators to the uneven roof surface. Accordingly, the present invention also provides solutions for adapting ventilators with planar extremities to non-planar roof surfaces as shown in FIGS. 16–18.

In one embodiment, separate adaptor panels 140 are provided which are capable of mating with both a ridge cap or fascia ventilator and an uneven roof surface. The adaptor panel 140 comprises a sheet of material having two distinct regions, a planar region 142 and a non-planar region 144. The non-planar region 144 is configured to mate snugly with a particular configuration of irregular roofing 146. FIG. 16 shows an adaptor panel 140 configured to mate with roofing 146 which is sinusoidally curved in cross-section. FIG. 18 shows an adaptor panel 140 that has the non-planar region 144 configured for snug receipt over a different roofing configuration.

Although the adaptation means has been illustrated in terms of separate panels, it should be understood the portions of the roof ridge ventilator or fascia ventilator could also be extended and then configured for receipt over an irregular roof surface. For instance, in the case of ridge cap ventilator 80, the ventilating member 82 could easily be extended beyond flange 98. This extended portion could then be molded to conform to an irregular roof surface.

In another aspect of the present invention, the ridge cap, fascia and gable ventilators described above are utilized in different combinations in a roof construction in order to achieve more efficient ventilating capacity.

Generally speaking, there is no preference embodiment for a particular type of ventilator, such as a ridge cap ventilator, when it is used in concert with other ventilators in a roof construction. However, it has been determined that ventilation is most fully and efficiently achieved when ventilators are provided at the roof ridge and along the base of the roof, such as at the gable and/or fascia. Without wishing to be bound by any theory of operation, it appears that this is so because eduction of warm air from the roof ridge creates a slightly lower pressure in the interior building space which draws in air from below through fascia and/or gable ventilators. Without a means of replacing air lost through the roof ridge, the lowering internal pressure would eventually inhibit the ability of warm air to exit through the roof ridge. When ventilation occurs below the roof ridge, a circulation pattern is created within the building space where air moves in from the outside in the lower reaches of the building space and exits through the roof ridge as it heats and rises.

Although ventilation is satisfactory when a roof construction is provided with only a ridge cap ventilator and a gable or a fascia ventilator, it is preferable to employ all three ventilator types in a single roof construction for maximum ventilating effect.

It is now apparent that the ventilators and ventilating systems of the present invention, as described and illustrated above, show marked improvements over available ventilators. It is to be understood, however, that although certain preferred embodiments have been disclosed and described above, other embodiments and changes are possible without departing from that which is the invention disclosed herein. It is intended therefore that the following claims define the invention, and that the structure within the scope of these claims and their equivalents be covered thereby.

I claim:

1. For ventilating a space within a building through a roof having a roof ridge gap transversely extending across the roof along an axis that defines a roof ridge and divides the roof into a first side and a second side, a ridge cap ventilator comprising:

a first corrugated ventilating member configured for receipt by the first roof side proximate to the roof ridge gap and a second corrugated ventilating member configured for receipt by the second roof side proximate to the roof ridge gap;

a cover member configured for receipt over the roof ridge gap and receipt by the first and second corrugated ventilating members, wherein the first and second corrugated ventilating members provide a single row of downwardly sloped, substantially parallel channels when said ventilating members are in place between and joined to said cover member and said roof sides, each channel having an upwardly facing end in communication with the roof ridge gap and a downwardly facing end in communication with the outside air; and means for preventing outside air from blowing into the downwardly facing ends of the channels of said first and second corrugated ventilating members.

2. The ridge cap ventilator of claim 1 wherein the preventing means comprises a first flange and a second flange adjacent to, but spaced apart from the downwardly facing ends of the channels of said first and second ventilating members, said flanges configured for receipt by the roof sides and to project above the downwardly facing ends of the channels.

3. The ridge cap ventilator of claim 2 further comprising a fiberglass mesh filter interposed between the roof sides and said ventilating members for preventing entry of insects and similar sized pests into the building space.

4. For ventilating a space within a building through a roof having a roof ridge gap transversely extending across the roof along an axis that defines a roof ridge and divides the roof into a first side and a second side, a ridge cap ventilator comprising:

a first corrugated ventilating member configured for receipt by the first roof side proximate to the roof ridge gap and a second corrugated ventilating member configured for receipt by the second roof side proximate to the roof ridge gap;

a cover member configured for receipt over the roof ridge gap and configured for receipt by the first and second corrugated ventilating members, wherein the first and second corrugated ventilating members provide a single row of downwardly sloped substantially parallel channels when said first and second corrugated ventilating members are in place between and joined to said cover member and said roof sides, each channel having an upwardly facing end in communication with the roof ridge gap and a downwardly facing end in communication with outside air;

a first flange and a second flange adjacent to but spaced apart from the downwardly facing ends of the channels of said first and second corrugated ventilating members, said flanges configured for receipt by the roof sides and to project above the downwardly facing ends of the channels to prevent outside air from blowing directly into the channels; and a fiberglass mesh filter interposed between the roof sides and said first and second corrugated ventilating members for preventing the entry of insects and similar sized pests into the building space.

5. The ridge cap ventilator of claim 1 or 4 further comprising means for adapting said ridge cap to a roof having a non-planar surface configuration.

6. The ridge cap ventilator of claim 5 wherein the adaptation means is a sheet of material having a substantially planar first portion capable of receipt under said ventilating members and a second portion configured for receipt by the non-planar roof surface.

7. For ventilating a space within a building through a roof having a roof ridge gap transversely extending across the roof along an axis that defines a ridge of the roof and that divides the roof into a first side and a second side, a ridge cap ventilator comprising:

a ventilating member configured for receipt over the roof ridge gap and for receipt by the first and second roof sides, said ventilating member provided with sloping opposed sides which meet to form a cap ridge and with a plurality of raised ribs alternating with troughs, the ribs extending downward along the opposed sides from the cap ridge, each raised rib forming a channel when in contact with the roof and having an open first end and an open second end in communication with outside air; and means for preventing outside air from blowing directly into the apertures of the ribs.

8. The ridge cap ventilator of claim 7 wherein the preventing means comprises a first flange and a second flange formed in the ventilating member adjacent to but spaced apart from the open ends of the ribs of the ventilating member, said flanges configured to project above the open ends of the ribs.

9. The ridge cap ventilator of claim 7 further comprising a fiberglass mesh filter interposed between the roof sides and said ventilating member for preventing entry of insects and like pests into the building space.

10. The ridge cap ventilator of claim 7 further comprising means for adapting said ventilating member to a roof having a non-planar surface.

11. The ridge cap ventilator of claim 10 wherein the adaptation means is a sheet of material having a substantially planar first portion capable of receipt by said ventilating member and a second portion configured for receipt by the non-planar roof surface.

12. The ridge cap ventilator of claim 10 wherein the adaptation means comprises a portion of said ventilating member which projects outward from the flange relative to the ribs, said projecting portion configured for receipt by the non-planar roof surface.

13. The ridge cap ventilator of claim 7 further comprising a cover member configured for receipt over the ribs of said ventilating member, thereby converting the plurality of troughs to a plurality of air passages, said ventilating member further provided with at least one aperture positioned proximate to the cap ridge of the ventilating member in each air passage and in communication with the roof ridge gap when the ridge cap is in place.

14. The ridge cap ventilator of claim 13 further comprising a fiberglass mesh filter interposed between the roof sides and said ventilating member for preventing entry of insects and like pests into the roof space.

15. The cap of claim 13 further comprising means for adapting said ventilating member to a roof having a non-planar surface.

16. The ridge cap ventilator of claim 15 wherein the adapting means comprises a strip projecting from said ventilating member, the strip configured for receipt by the non-planar roof surface.

17. For ventilating a space within a building through a roof having a roof ridge gap transversely extending across the roof along an axis that defines an ridge of the roof and that divides the roof into a first side and a second side, a ridge cap ventilator comprising:

a ventilating member configured for receipt over the roof ridge gap and for receipt by the first and second roof sides, said ventilating member provided with sloping opposed sides which meet to form a cap ridge and with a plurality of raised ribs alternating with a plurality of troughs, the ribs extending downward along the opposed sides from the cap ridge, each raised rib forming a channel when in contact with the roof and having a first open end and a second open end in communication with outside air;

means for preventing outside air from blowing directly into the apertures of the ribs;

means for adapting said ventilating member to a roof having a non-planar surface; and means for preventing the entry of insects and like pests into the building space.

18. A system for ventilating a building space through a roof having at least one cornice gap and a roof ridge gap transversely extending across the roof along an axis that defines a roof ridge and divides the roof into a first side and a second side, said system comprising:

a ridge cap ventilator attached to and covering the roof ridge gap, said ridge cap comprising a first corrugated ventilating member configured for receipt by the first roof side proximate to the roof ridge gap and a second corrugated ventilating member configured for receipt by the second roof side proximate to the roof ridge gap, and a cover member configured for receipt over the roof ridge gap and configured for receipt by the first and second corrugated ventilating members, wherein the first and second corrugated ventilating members provide a single row of downwardly sloped substantially parallel channels when said first and second corrugated ventilating members are in place between and joined to said cover member and said roof sides, each channel having an upwardly facing end in communication with the roof ridge gap and a downwardly facing end in communication with outside air; and a fascia ventilator attached to and covering the at least one cornice gap, said fascia ventilator comprising a third ventilating member configured for receipt over the gap in the cornice and provided with a plurality of apertures and a cover member configured for receipt by the cornice above the gap and for extending down over but spaced apart from said third ventilating member, said cover member provided with a drip lip to prevent precipitation shed by the roof from running down the building, wherein warm air rises to the roof ridge gap, is educed from the building downwardly through said ridge cap and is replaced by air entering the building space through said fascia assembly from outside the building.

19. A system for ventilating a building space through a roof having at least one cornice gap and a roof ridge gap transversely extending across the roof along an axis that defines a roof ridge and divides the roof into a first side and a second side, said system comprising:

a ridge cap ventilator attached to and covering the roof ridge gap, said ridge cap comprising a corrugated ventilating member configured for receipt over the rood ridge gap and for receipt by the first and second roof sides, said ventilating member provided with sloping opposed sides which meet to form a cap ridge and with a plurality of raised ribs alternating with a plurality of troughs, the ribs extending downward along the opposed sides from the cap ridge, each raised rib forming a channel when in contact with the roof and having a first open end in communication with the roof ridge gap and a second open end in communication with outside air; and a fascia ventilator attached to and covering the at least one cornice gap, said fascia ventilator comprising a third ventilating member configured for receipt over the gap in the cornice and provided with a plurality of apertures and a cover member configured for receipt by the cornice above the gap and for extending down over but spaced apart from said third ventilating member, said cover member provided with a drip lip to prevent precipitation shed by the roof from running down the building, wherein warm air rises to the roof ridge gap, is educed from the building downwardly through said ridge cap and is replaced by air entering the building space through said fascia assembly from outside the building.

20. A system for ventilating a building space through a roof having at least one cornice gap and a roof ridge gap transversely extending across the roof along an axis that defines a roof ridge and divides the roof into a first side and a second side, said system comprising:

a ridge cap ventilator attached to and covering the roof ridge gap, said ridge cap comprising a first corrugated ventilating member configured for receipt by the first roof side proximate to the roof ridge gap and a second corrugated ventilating member configured for receipt by the second roof side proximate to the roof ridge gap, and a cover member configured for receipt over the roof ridge gap and configured for receipt by the first and second corrugated ventilating members, wherein the first and second corrugated ventilating members provide a single row of downwardly sloped substantially parallel channels when said first and second corrugated ventilating members are in place between and joined to said cover member and said roof sides, each channel having an upwardly facing end in communication with the roof ridge gap and a downwardly facing end in communication with outside air; and a fascia ventilator attached to and covering the cornice gap, said fascia ventilator comprising a third ventilating member configured for receipt by the cornice beneath the gap, and a cover member configured for receipt by the cornice above the gap and for receipt over and joinder with said third ventilating member to form a plurality of substantially parallel closed channels between said third ventilating member and said cover member, wherein warm air rises to the roof ridge gap, is educed from the building downwardly through said ridge cap and is replaced by air entering the building space through said fascia assembly from outside the building.

21. A system for ventilating a building space through a roof having at least one cornice gap and a roof ridge gap transversely extending across the roof along an axis that defines a roof ridge and divides the roof into a first side and a second side, said system comprising:

a ridge cap ventilator attached to and covering the roof ridge gap, said ridge cap comprising a corrugated ventilating member configured for receipt over the rood ridge gap and for receipt by the first and second roof sides, said ventilating member provided with sloping opposed sides which meet to form a cap ridge and with a plurality of raised ribs alternating with a plurality of troughs, the ribs extending downward along the opposed sides from the cap ridge, each raised rib forming a channel when in contact with the roof and having a first open end in communication with the roof ridge gap and a second open end in communication with outside air; and a fascia ventilator attached to and covering the cornice gap, said fascia ventilator comprising a third ventilating member configured for receipt by the cornice beneath the gap, and a cover member configured for receipt by the cornice above the gap and for receipt over and joinder with said third ventilating member to form a plurality of substantially parallel closed channels between said third ventilating member and said cover member, wherein warm air rises to the roof ridge gap, is educed from the building downwardly through said ridge cap and is replaced by air entering the building space through said fascia assembly from outside the building.

22. A system for ventilating a building space through a roof having a roof ridge gap transversely extending across the roof along an axis that defines a roof ridge and divides the roof into a first side and second side, and a gable, said system comprising:

a ridge cap ventilator attached to and covering the roof ridge gap, said ridge cap comprising a first ventilating member configured for receipt by the first roof side proximate to the roof ridge gap and a second ventilating member configured for receipt by the second roof side proximate to the roof ridge gap, and a cover member configured for receipt over the roof ridge gap and receipt by the first and second ventilating members, wherein the first and second ventilating members are configured to provide a single row of downwardly sloped substantially parallel channels when said ventilating members are in place between said cover member and said roof sides, each channel having an upwardly facing end in communication with the roof ridge gap and a downwardly facing end in communication with outside air; and a gable ventilator incorporated into the gable, said gable ventilator comprising a vent member having a first portion with a first free edge, a central second portion contiguous with said first portion and provided with a plurality of apertures, and a third portion with a groove configured for snug receipt over an end of the eave panel and a bracket configured to receive and partially support said vent member on the gable;

wherein warm air rises to the roof ridge gap, is educed from the building downwardly through said ridge cap and is replaced by air entering the building space through said gable assembly from outside the building.

23. A system for ventilating a building space through a roof having a roof ridge gap transversely extending across the roof along an axis that defines a roof ridge and divides the roof into a first side and second side, and a gable, said system comprising:

a ridge cap ventilator attached to and covering the roof ridge gap, said ridge cap comprising a ventilating member configured for receipt over the roof ridge gap and for receipt by the first and second roof sides, said ventilating member provided with sloping opposed sides which meet to form a cap ridge and with a plurality of raised ribs alternating with a plurality of troughs, the ribs extending downward along the opposed sides from the cap ridge, each raised rib forming a channel when in contact with the roof and having a first open end and a second open end in communication with outside air; and a gable ventilator incorporated into the gable, said gable ventilator a vent member having a first portion with a first free edge, a central second portion contiguous with said first portion and provided with a plurality of apertures, and a third portion with a groove configured for snug receipt over an end of the eave panel and a bracket configured to receive and partially support said vent member on the gable, wherein warm air rises to the roof ridge gap, is educed from the building downwardly through said ridge cap and is replaced by air entering the building space through said gable assembly from outside the building.

* * * * *